United States Patent [19]

Messé et al.

[11] 4,415,874

[45] Nov. 15, 1983

[54] ELECTRIC SHUNT INDUCTANCE WINDING FOR AN ELECTRICITY POWER TRANSPORT LINE

[75] Inventors: Gérard Messé, Maule; Michel Faure, Houilles, both of France

[73] Assignee: Societe Anonyme dite: Alsthom-Atlantique, Paris, France

[21] Appl. No.: 279,648

[22] Filed: Jul. 2, 1981

[30] Foreign Application Priority Data

Jul. 4, 1980 [FR] France ..... 80 14918

[51] Int. Cl.[3] ..... H01F 27/26

[52] U.S. Cl. ..... 336/178; 336/210

[58] Field of Search ..... 310/217, 218; 336/210, 336/212, 178, 92, 100; 29/602 R, 606

[56] References Cited

U.S. PATENT DOCUMENTS

| | | | |
|---|---|---|---|
| 3,175,174 | 3/1965 | Simmons | 336/92 |
| 3,195,082 | 7/1965 | Wetherill et al. | 336/210 X |
| 3,341,793 | 9/1967 | Wale et al. | 336/210 X |
| 3,792,397 | 2/1974 | Reinemann | 336/210 |

FOREIGN PATENT DOCUMENTS

| | | | |
|---|---|---|---|
| 1174899 | 7/1964 | Fed. Rep. of Germany | 336/210 |
| 2632585 | 1/1978 | Fed. Rep. of Germany | 336/210 |
| 1285185 | 1/1962 | France | 336/210 |
| 2013335 | 4/1970 | France | 336/210 |
| 990520 | 4/1965 | United Kingdom | 336/210 |

*Primary Examiner*—Thomas J. Kozma

*Attorney, Agent, or Firm*—Sughrue, Mion, Zinn, Macpeak and Seas

[57] ABSTRACT

The invention relates to a device for tightening the core and the upper and lower cross pieces of a shunt inductance winding by means of a plurality of tie rods (5, 6, 7) which are preferably seven in number and which pass through the central hole of the core. A cup-shaped part (12) held by nuts (13) is fitted onto the tie rods, the outer wall of this part is threaded, a nut (14) is screwed onto this part (12) and bears against axially elastic washers (15).

4 Claims, 4 Drawing Figures

ELECTRIC SHUNT INDUCTANCE WINDING FOR AN ELECTRICITY POWER TRANSPORT LINE

FIELD OF THE INVENTION

The present invention relates to a shunt inductance winding.

BACKGROUND OF THE INVENTION

It is known to use shunt inductance windings to compensate the capacititive reactance of long electricity power transport lines, which are generally high-tension lines.

A known type of inductance winding has a magnetic core made of a stack of core members, themselves constitutes by stacks of iron laminations. The core members are separated from one another by gaps made of non-magnetic material. The winding also includes an electric winding which surrounds said core and a magnetic barrel to close the magnetic circuit. Such a magnetic barrel constitutes a magnetic circuit made of iron laminations and comprises two vertical legs connected together by an upper cross bar and a lower cross bar, the core being located between the middles of the cross bars.

There are several solutions for clamping the cross bars against the central core.

One solution is to clamp them outside the winding which surrounds the core by means of tie rods and another is to place the tie rods between the core and the winding.

These two solutions take up a lot of space and in the second, the weight of the copper winding is increased.

Another known solution consists in placing a fixing tie rod in the central hole of the core. From the point of view of saving space and copper, this solution is ideal; in contrast, the fixing system heats up because of eddy current losses in the tie rod.

SUMMARY OF THE INVENTION

The present invention therefore provides an electric shunt inductance winding for an electric power transport line with a magnetic core round which is installed an electric winding and a magnetic barrel to close the magnetic circuit. The magnetic barrel has two vertical legs connected together by an upper cross bar and a lower cross bar, said magnetic core having a central hole and being constituted by a vertical stack of laminated iron core members separated from one another by gaps made of non-magnetic material. The upper cross bar and the lower cross bar are clamped against the magnetic core and said vertical legs by means of a plurality of tie rods made of non-magnetic material which pass through said central hole. Spacing washers are placed at regular intervals along the tie rods so as to prevent them from vibrating.

According to a particularly advantageous embodiment of the invention there are seven tie rod, one of which is located on the axis of the central hole of the core, while the six others are evenly spaced out therearound.

The tie rods are tightened by means of a cup-shaped part whose base has seven holes in it and is fitted onto the upper ends of the tie rods. Nuts on the tie rods prevent said cup-shaped part from being removed, its outer periphery being threaded and a nut which bears against axially elastic washers being screwed thereon, said washers exerting a pressing force on the upper cross bar.

According to one embodiment said nut which bears against washers is divided into two superposed parts which can be screwed separately on said cup-shaped part, the upper part of said nut having a top end with a tapped hole in it.

The invention also provides a method of tightening the two part nut against said washers wherein a hollow jack is used which has a skirt and a rod which moves axially inside the skirt, the skirt bearing against said washers and the rod being screwed in. Pressure is applied the rod retracts into the body of the jack and applies pressure to the washers by means of said skirt. The lower part of said nut is hand tightened through an orifice in the skirt until the nut comes into contact with the washers, the pressure in the jack is released, the rod of the jack is unscrewed from the upper part of the nut, and the upper part of the nut is screwed onto said cup-shaped part until it comes into contact with the lower part of said nut.

The invention will be better understood from the following description of an embodiment of the invention given by way of example with reference to the accompanying drawings.

DESCRIPTION OF THE PREFERRED EMBODIMENT

Figure 3:
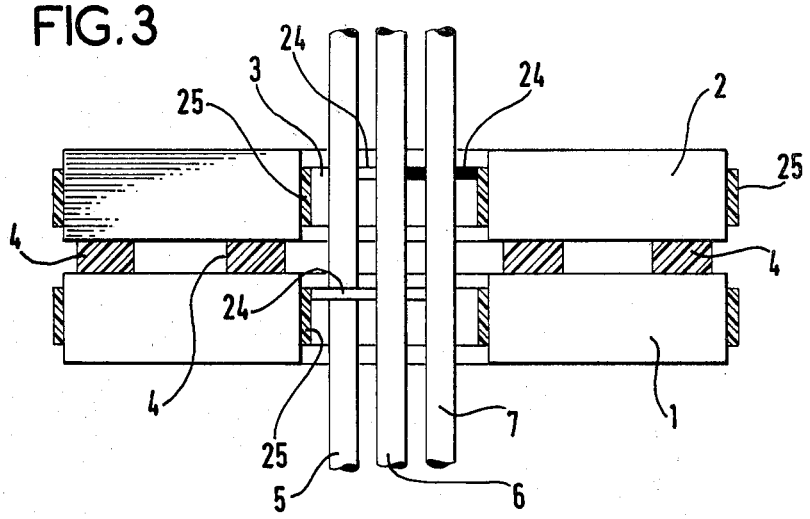
FIG. 3 is a partial cross-section of the magnetic core.

FIG. 3 shows a small portion of a magnetic core of a shunt inductance winding. Such a core is made of a stack of core members themselves constituted by stacks of iron laminations. Only two of the core members, 1 and 2, are shown in this figure. The core members are cylindrical and each has a central hole 3. The core members are separated from one another by gaps or spacers 4 made of non-magnetic material. An upper cross bar is located at the top of the magnetic core and a lower cross bar is located at the bottom of the magnetic core. The upper cross bar is connected to the lower cross bar by vertical legs. Neither the cross-bars nor the legs are illustrated in FIG. 3.

Figure 1:
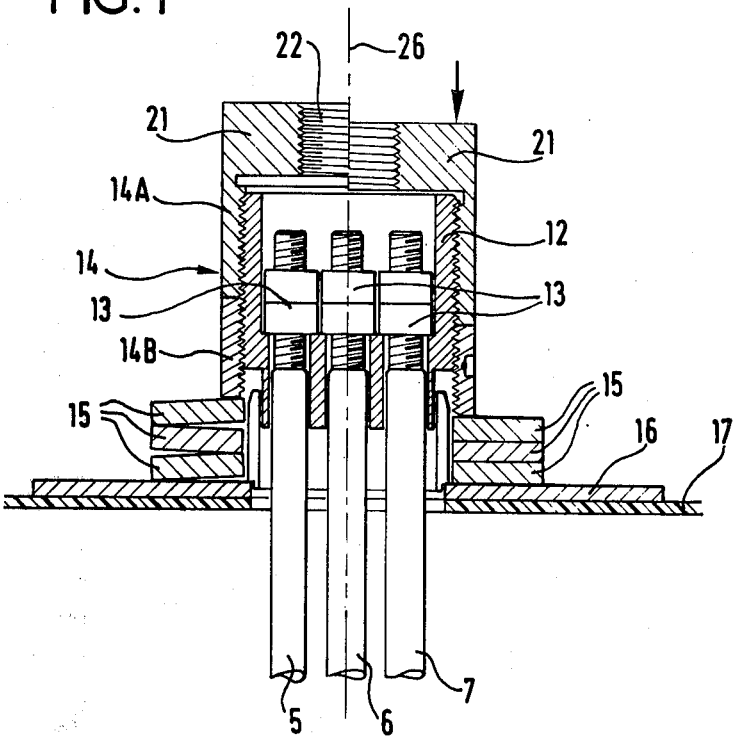
FIG. 1 is a partial cross-section of the clamping means for the core of a shunt inductance winding in accordance with the invention.

To tighten the magnetic core and the cross bars against this core, seven tie rods 5, 6, 7, 8, 9, 10 and 11 are used, only three of these tie rods being shown in FIGS. 1 and 3.

Figure 2:
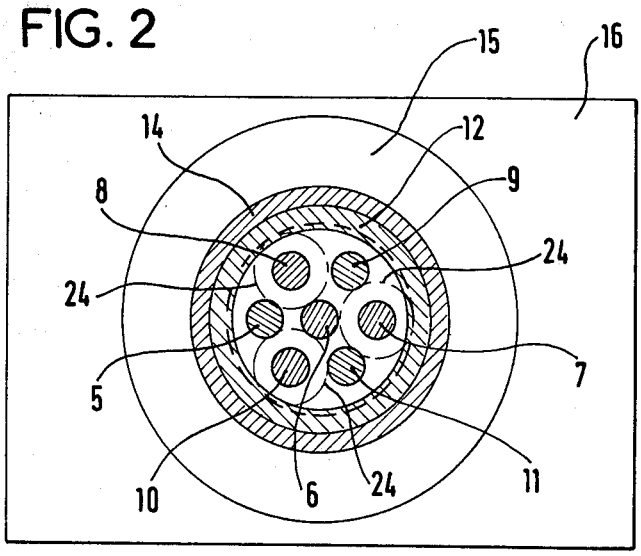
FIG. 2 is a top view of FIG. 1.

As seen in FIG. 2, one (6) of these tie rods is placed in the axis of the core and the others are spaced out evenly therearound.

FIG. 1 shows the means by which the tie rods are tightened and kept tight. In this figure, the portion located to the left of the axis 26 is shown before tightening and the portion located to the right of the axis 26 is shown after tightening. A cup-shaped part 12 with a threaded outer cylindrical wall has the ends of the tie rods threaded through its base. Nuts 13 fix the part 12 on the tie rods. A nut 14, comprising two independent parts 14A and 14B, is screwed onto the outer wall of the cup-shaped part 12 and the lower end of the part 14B of the nut bears against washers 15 which are slightly elastic in the axial direction. The washers 15 rest on the upper cross bar not illustrated by means of a bearing plate 16 and an insulator 17.

Figure 4:
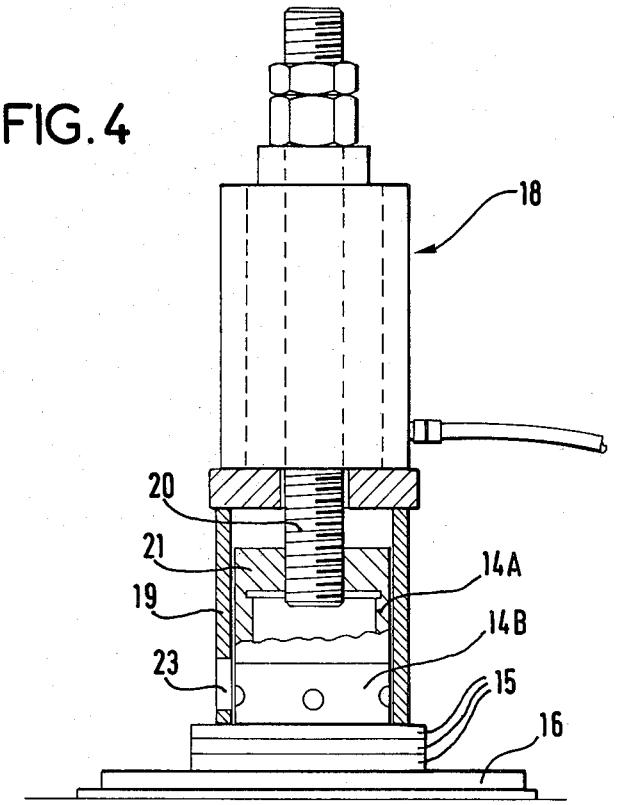
FIG. 4 is a vertical elevation, partially in section, of the clamping means.

To clamp the assembly together, the nut 14 must be tightened on the cup-shaped part 12 so as to squash the washers 15. To do this, as illustrated in FIG. 4, a hollow jack 18 is used which has a skirt 19 bearing against the washers 15, and a rod 20 which is screwed into the base 21 of the nut 14A which has a tapped hole 22. To begin with, the assembly is loose and is as shown in the left-hand portion of FIG. 1. When pressure is applied to the jack, the rod 20 of the jack retracts into the jack body and the skirt 19 bears down against the washers 15.

Part 14B of the nut 14 can then be screwed down via an orifice 23 in the skirt 19 until it comes into contact with the washers 15. The pressure in the jack is then released, the jack is unscrewed and the part 14A of the nut 14 is screwed down until it comes into contact again with the part 14B.

To prevent the tie rods from vibrating, spacing washers 24 are placed thereon: three washers are placed level with each iron core member. For example, a washer is placed level with core member 2 (FIG. 3) on the tie tods 7, 8 and 10 as shown in FIG. 2. FIG. 3 shows the washer 24 on the tie rod 7 and a part of the washer located on the tie rod 8 which is placed behind the tie rods 5 and 6. Washers are placed level with the next core member, e.g. core member 1, on the tie rods 5, 9 and 11. These washers bear against an insulating cylinder 25 located inside the central hole of each section.

Therefore, the clamping means in accordance with the invention take up very little space and the tie rods do not heat up very much. Further, there are only seven tie rods—a number which allows the best filling of the hole for a given diameter and it also allows very practical tie rod jamming by means of triplets of washers staggered alternately level with each successive core member.

It will be readily appreciated that the various terms designating a particular orientation, such as "vertical", "upper", "lower", etc. refer to the normal dispositions of the members so designated. Naturally it is quite possible for a winding to be differently oriented, e.g. on its side. In particular, in the claims, such terms should be interpreted as applying to the winding when appropriately oriented.

We claim:

1. An electric shunt inductance winding for an electric power transport line, said inductance winding including a magnetic core, an electric winding surrounding said core, a magnetic barrel surrounding the electric winding to close the magnetic circuit, said magnetic barrel having two vertical legs, an upper cross bar and a lower cross bar connecting said legs together at opposite ends thereof, said magnetic core having a central hole and being constituted by a vertical stack of laminated iron core members separated from one another by spacers made of non-magnetic material, the improvement wherein the upper cross bar and the lower cross bar are clamped against the magnetic core and said vertical legs by means of a plurality of tie rods made of non-magnetic material passed through said central hole and through said cross-bars and spacing washers placed at regular intervals along the tie rods so as to prevent them from vibrating.

2. An electric shunt inductance winding according to claim 1, wherein there are seven tie rods, one of which is located on the axis of the central hole of the core, six others evenly spaced out therearound.

3. An electric shunt inductance winding according to claim 2, wherein a cup-shaped part has a base with seven holes in it and is fitted onto the upper ends of the tie rods, nuts on the tie rods preventing said cup-shaped part from being removed, the outer periphery of said cup-shaped part being threaded and a nut screwed thereon against axially elastic washers interposed between the magnetic core and said cup-shaped part, said washers exerting a pressing force on the upper cross-bar.

4. An electric shunt inductance winding according to claim 3, wherein said nut which bears against washers is divided into two superposed parts which can be screwed separately on said cup-shaped part, the upper part of said nut having a top end with a tapped hole in it.

* * * * *